United States Patent [19]

Clark

[11] 4,117,310

[45] Sep. 26, 1978

[54] ELECTRICAL SOCKET

[76] Inventor: Andrew Greive Clark, 2414 Conquest Dr., Mississauga, Ontario, Canada

[21] Appl. No.: 765,549

[22] Filed: Feb. 4, 1977

[51] Int. Cl.[2] ..... H05B 3/08

[52] U.S. Cl. ..... 219/451; 219/463; 339/14 T

[58] Field of Search ..... 219/443, 447, 451, 452, 219/453, 463, 541; 339/14 R, 14 P, 14 T, 65

[56] References Cited

U.S. PATENT DOCUMENTS

| | | | |
|---|---|---|---|
| 3,021,414 | 2/1962 | Sand | 219/451 |
| 3,327,095 | 6/1967 | Hanson | 219/451 |
| 3,328,562 | 6/1967 | Jasienowski | 219/451 |
| 3,466,427 | 9/1969 | Burger | 219/451 |
| 3,569,671 | 3/1971 | Henning et al. | 219/451 |
| 3,571,562 | 3/1971 | Cunningham | 219/451 |
| 3,696,232 | 10/1972 | Salinger | 219/451 |

*Primary Examiner*—Volodymyr Y. Mayewsky
*Attorney, Agent, or Firm*—Ridout & Maybee

[57] ABSTRACT

An improved socket assembly is described for plug-in heating elements for stove tops, in which a guide sleeve includes inwardly projecting shelves which engage a grounding member on the element and prevent it from being lowered to a horizontal position in a stove top aperture until its contact members are fully engaged in the socket.

2 Claims, 4 Drawing Figures

ELECTRICAL SOCKET

FIELD OF THE INVENTION

This invention relates to socket assemblies for plug-in electrical heating elements such as those used in stove tops.

REVIEW OF THE PRIOR ART

At one time fixed socket assemblies were provided for plug-in electrical heating elements in domestic cooking stoves, but with such socket assemblies it is difficult to achieve sufficiently strict assembly tolerances to ensure that an element once plugged in will both fit correctly into its opening in the stove top and be properly engaged in the socket assembly.

In order to overcome this problem an arrangement has been adopted, an embodiment of which is described in more detail in U.S. Pat. No. 3,571,562, issued Mar. 23, 1971 to Donald M. Cunningham, in which a socket member is supported, with a certain amount of pivotal and translational "float", by an interlocking sheet metal sleeve embracing the socket member, which sleeve both acts as a carrier for the socket member and forms a guide passage through which the contact members of a heating element may be guided into the sockets of the socket member. The walls of the guide passage also resiliently engage a grounding and locating member on the element through which the contact members extend so as to establish a ground connection. The sleeve is itself resiliently mounted on the stove structure. With this arrangement, the socket member has sufficient float to adjust its position to that of the heating element when the latter is correctly located in the stove top, and thus to accommodate manufacturing and assembly tolerances.

It has been found however that it is occasionally possible with this arrangement for the heating element to be located in the stove top without proper engagement of the contact members in the sockets of the socket member having been achieved, the socket member being forced back by the contact members with the latter entering the sockets only partially or not at all. It has also been found that due to residual stresses in the heating element, the contact members are drawn towards the body of the heating element as it is used, and may withdraw from proper engagement with the socket. This can lead to lack of function of the heating element, or overheating of the socket member and contact members.

The object of the present invention is to provide an improvement upon the above arrangement in which the heating element will not seat properly in the stove top unless the contact members are properly engaged in the sockets, and proper contact will be maintained during use of the heating element.

SUMMARY OF THE INVENTION

Accordingly the invention provides, in a socket assembly for a plug-in electrical heating element for a stove, comprising a socket member defining horizontal sockets configured to receive contact members on the heating element and containing conductor elements resiliently engageable with said contact members, and a guide and carrier member which loosely and interlockingly embraces said socket member so as to support the latter whilst permitting a limited degree of pivotal and translational movement relative to the guide and carrier member, said latter member also defining the walls of a generally horizontally extending guide passage through which said contact members must be passed to reach the sockets in said socket member, the walls of said guide passage receiving and being engageable with a grounding and locating member on the heating element from which member the contact members project, the improvement in which inwardly projecting shelves are formed on the side walls of said guide passage having an inward and rearward extent such as to engage the bottom of the grounding and locating member and prevent it from approaching the bottom wall of the passage until the contact members are fully engaged in the sockets.

When a heating element of the type under discussion is plugged into a stove top, the contact members of the element are pointed downwardly and radially outwardly relative to the opening in the stove top and moved outwardly relative to the opening through the guide passage into the sockets in the socket member until the remainder of the element can be lowered downwardly into a horizontal position in the opening in the stove top. The presence of the shelves in the guide passage ensures that the lowering of the remainder of the element into the stove opening cannot occur until the contact members are fully engaged in the sockets, the shelves engaging the grounding and locating member and thus preventing such lowering.

SHORT DESCRIPTION OF THE DRAWINGS

In the accompanying drawings:

FIG. 1 is a side elevation of a socket assembly in accordance with the invention, FIG. 2 is a plan view of the assembly, FIG. 3 is an underside plan view of the assembly, and FIG. 4 is a longitudinal vertical section through the assembly, showing part of a heating element in different stages of engagement with the socket assembly.

DESCRIPTION OF THE PREFERRED EMBODIMENT

Figure 2:
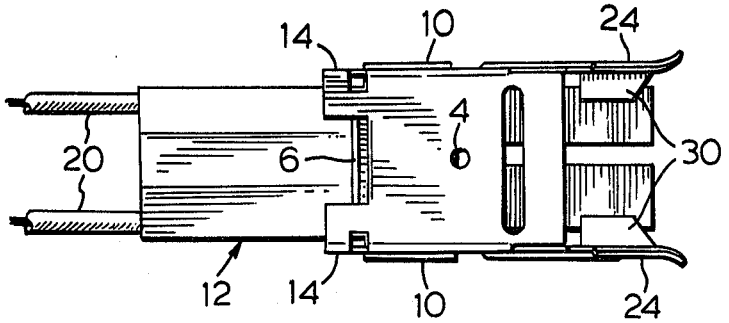
Figure 1:
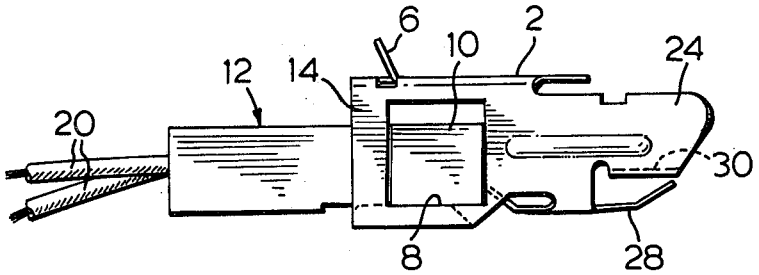
Figure 3:
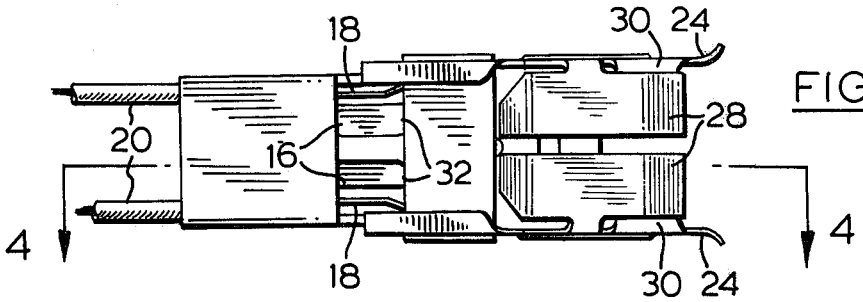
Figure 4:
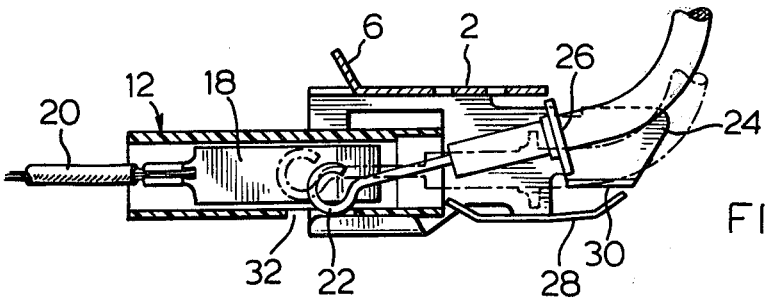

The assembly is in most respects similar to that described in U.S. Pat. No. 3,571,562 except as to the manner in which the sleeve is secured to the stove top, and therefore will not be described in great detail. A sheet metal sleeve 2 is secured to the periphery of an aperture in a stove top by means of a member (not shown) welded to the sleeve or secured by a rivet passing through the hole 4, and is steadied against the underside of the stove top by the upturned flange 6. Apertures 8 in the side walls of the sleeve loosely interlock with lugs 10 on a socket member 12, the front portion of which is embraced by the rear portion of the sleeve 2. The socket member may be snapped into place in the sleeve by springing apart the side walls 14 of the latter. The socket member is formed with horizontal longitudinally extending sockets 16 (two in the example shown) each having a contact blade 18 captive therein and connected to a supply cable 20. The engagement between the sleeve and the socket is loose enough to allow a limited measure of translational and pivotal float of the socket relative to the sleeve so that the socket may adjust its position relative to the stove top aperture (not shown) to take up manufacturing and assembly tolerances.

The front portion of the sleeve forms a guide passage for the insertion of the contact members 22 of a plug-in heating element into the sockets 16, and the side walls 24 of this guide passage resiliently engage a grounding and locating member 26 on the heating element and through which the contact members 22 project, so as to ground the element. The walls 24 carry inturned flanges 28 which together form the bottom wall of the sleeve. The ends of these flanges are upwardly inclined.

As described so far, the socket assembly is known in the art. However, in the assembly of the present invention, the walls 24 carry further inturned flanges 30 which form shelves having an extent and for a purpose described below.

When a heating element is to be installed in an aperture in a stove top peripherally of which the socket assembly is mounted, the element is held with its contact members facing downwardly and radially outwardly relative to the aperture, and the members are moved into the open end of the sleeve 2, where they are engaged by the flanges 28 which guide them into the sockets 16. In the prior art arrangement, the remainder of the element is lowered into the aperture in the stove top as the contact members pass into the aperture and the member 26 engages the walls 24. However, in the present instance, the shelves formed by the flanges 30 engage the member 26 and this, together with the engagement of the contact members with the socket, prevents the element from being lowered to a horizontal position until the member 26 passes beyond the rear ends of the shelves, whose length is such as to ensure that the member 26 does not pass them until the contact members 22 are fully engaged with the contact blades 18 in the sockets 16.

This entails that the members 22 enter the sockets 16 in an inclined position, and in order to provide sufficient vertical clearances in the sockets, it may be necessary to form the bottom wall of the socket member with apertures 32 into the sockets, adjacent the positions assumed by the contact blades when fully inserted. However, the apertures 32 will not normally be required and may be omitted.

What I claim is:

1. In a socket assembly for a plug-in electrical heating element for a stove, comprising a socket member of rigid dielectric material defining horizontal sockets configured to receive contact members on the heating element and containing conductor elements resiliently engageable with said contact members, and a guide and carrier member which loosely and interlockingly embraces said socket member so as to support the latter whilst permitting a limited degree of pivotal and translational movement relative to the guide and carrier member, said latter member also defining the walls of a generally horizontally extending guide passage through which said contact members must be passed to reach the sockets in said socket member, the walls of said guide passage receiving and being engageable with a grounding and locating member on the heating element from which member the contact members project, the improvement in which inwardly projecting shelves are formed on the side walls of said guide passage having an inward and rearward extent such as to engage the bottom of the grounding and locating member and prevent it from approaching the bottom wall of the passage and the heating element from being lowered to a horizontal position until the contact members are fully engaged in the sockets and the grounding and locating member has passed beyond the rear ends of the shelves.

2. A socket assembly according to claim 1, wherein the guide and carrier member is a one piece sheet metal pressing, and the shelves are formed by integral inturned flanges at the bottom edges of the side walls of the guide passage.

* * * * *